US009203175B1

(12) United States Patent
Osa

(10) Patent No.: US 9,203,175 B1
(45) Date of Patent: Dec. 1, 2015

(54) INLINE CONNECTOR ASSEMBLY

(71) Applicant: PMT Corporation, St. Paul, MN (US)

(72) Inventor: Benjamin J. Osa, Chanhassen, MN (US)

(73) Assignee: PMT Corporation, Chanhassen, MN (US)

( * ) Notice: Subject to any disclaimer, the term of this patent is extended or adjusted under 35 U.S.C. 154(b) by 82 days.

(21) Appl. No.: 14/163,357

(22) Filed: Jan. 24, 2014

Related U.S. Application Data

(60) Provisional application No. 61/756,237, filed on Jan. 24, 2013.

(51) Int. Cl.
*H01R 24/58* (2011.01)
*H01R 13/50* (2006.01)

(52) U.S. Cl.
CPC ..... *H01R 13/501* (2013.01); *H01R 24/58* (2013.01)

(58) Field of Classification Search
USPC ..... 439/668–670, 822, 909
See application file for complete search history.

(56) References Cited

U.S. PATENT DOCUMENTS

| | | | | |
|---|---|---|---|---|
| 4,869,255 | A * | 9/1989 | Putz | 600/378 |
| 5,560,358 | A * | 10/1996 | Arnold et al. | 600/373 |
| 5,902,236 | A | 5/1999 | Iversen | |
| 6,162,101 | A * | 12/2000 | Fischer et al. | 439/729 |
| 6,662,035 | B2 | 12/2003 | Sochor | |
| 7,402,083 | B2 * | 7/2008 | Kast et al. | 439/660 |
| 7,425,142 | B1 | 9/2008 | Putz | |
| 7,798,862 | B2 * | 9/2010 | Kast et al. | 439/660 |
| 8,435,079 | B1 * | 5/2013 | Osa et al. | 439/668 |
| 8,574,001 | B2 * | 11/2013 | Lee | 439/490 |

* cited by examiner

*Primary Examiner* — Abdullah Riyami
*Assistant Examiner* — Harshad Patel
(74) *Attorney, Agent, or Firm* — Eggink & Eggink; Anthony G. Eggink; Katrina M. Eggink

(57) ABSTRACT

An inline connector assembly having a bottom body structure and a top body structure hingedly connected thereto. The bottom body structure has a plurality of resilient conductive members to receive the conductive portions of the inline tail which is received in a longitudinal bore in the top body structure. A latch structure is provided to maintain the inline connector assembly in a closed position. An electrode tail guide and stop member are provided in the inline connector assembly for ease of electrode insertion and tail contact alignment.

17 Claims, 5 Drawing Sheets

INLINE CONNECTOR ASSEMBLY

This application claims the benefit of U.S. Provisional Patent Application No. 61/756,237, filed on Jan. 24, 2013.

BACKGROUND OF THE INVENTION

The present invention relates generally to a connector assembly. Particularly, the invention relates to an inline connector assembly to connect a lead of an electrode for connection to EEG recording equipment.

Applicant's assignee is the owner of U.S. Pat. No. 5,902,236 issued May 11, 1999 for a Tissue Electrode for Recording and Stimulation, U.S. Pat. No. 6,162,101 issued Dec. 19, 2000 for a Connector Assembly for Electrodes and U.S. Pat. No. 8,435,079 issued on May 7, 2013 for an Electrode for Recording and Stimulation. These U.S. Patents all disclose connector assemblies and are incorporated by reference herein.

The inline connector assembly of the present invention is an improvement over the above referenced connector assemblies as well as over the connector assemblies of the prior art.

SUMMARY OF THE INVENTION

An inline connector assembly having a bottom body structure, a top body structure and a hinged connecting member which permits the opening and closing of the assembly and to receive and secure the tail of an electrode lead. The bottom body structure has a longitudinal channel of a predetermined width and which is defined by a plurality of spaced and opposing resilient conductive members. The top body structure is hinged at one end to the bottom body structure and has a longitudinal bore, which aligns with the longitudinal channel of the bottom body structure. The longitudinal bore of the top body structure is comprised of a plurality of aligned lead holding members, each having an aperture. The latter being constructed to receive an inline tail of the lead of an electrode assembly. The tail having a plurality of contacts, for example, are conductively held between the opposing resilient conductive members of the bottom body structure when the connector assembly is in a closed position. The bottom body structure has an interconnection cable for connection to EEG recording equipment or to a quick disconnect structure.

The inline connector assembly is further provided with a cooperating latch structure to lock the bottom body and top body structures of the assembly when in a closed position. Also provided are means to guide the tail of an electrode structure into the longitudinal bore of the top body structure and means to position the electrode tail in proper alignment within the connector assembly.

The inline connector assembly has top and bottom body members constructed of nonconductive polymeric materials which may include optically clear portions to permit a user to view the alignment of the inline tail contacts between the opposing resilient conductive members of the bottom body member. The resilient conductive members may be leaf springs which are oppositely arranged and aligned along the bottom body member and which form a longitudinal spacing or the longitudinal channel to receive the inline tail of an electrode. The oppositely arranged leaf spring members are spaced in the longitudinal direction to receive the spaced contacts of the inline tail and may also be utilized to engage non conductive tail portions between the tail contacts to further secure the inline tail within the connector assembly. The spacing between the opposing conductive leaf spring members forming the longitudinal channel in the bottom body portion is a predetermined distance which is less than the diameter of the inline tail structure.

An advantage of the present invention is an inline connector assembly which provides for the easy insertion of an inline tail into the assembly.

Another advantage of the invention is to provide for the secure connection of the electrode contacts of the inline tail of an electrode for electrical connection to EEG recording equipment.

These and other benefits of this invention will become clear from the following description by reference to the drawings.

DESCRIPTION OF THE PREFERRED EMBODIMENTS

Figure 1:
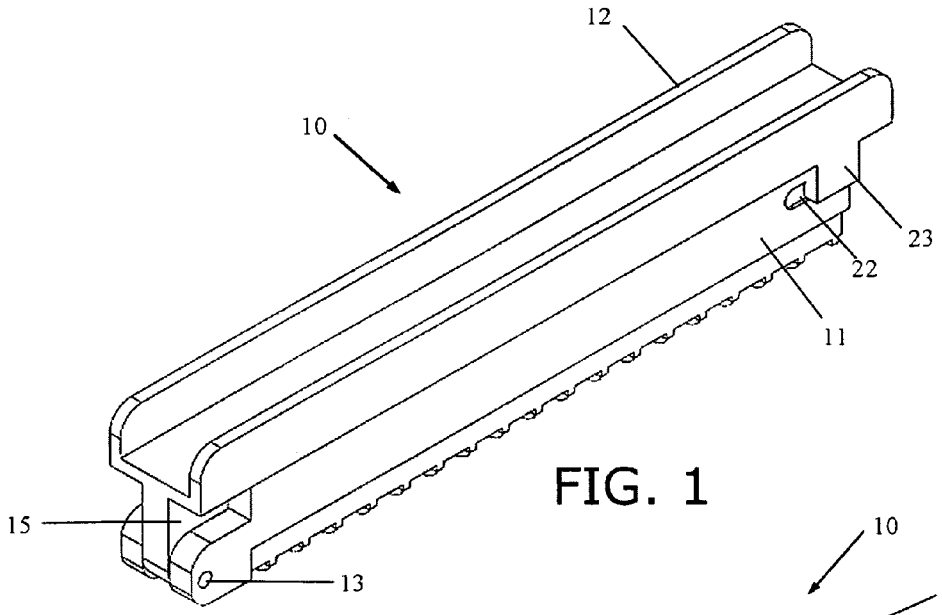
FIG. 1 is a perspective view of the inline connector assembly of the invention.
Figure 2:
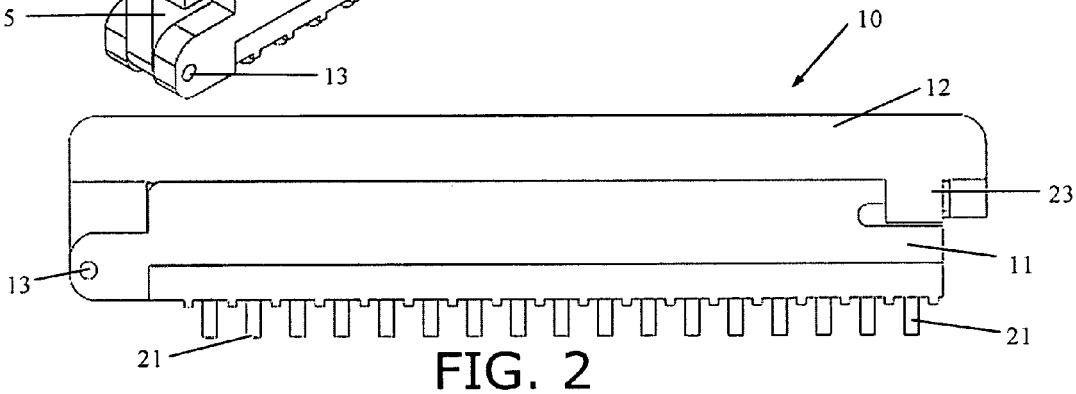
FIG. 2 is a lateral view of the inline connector assembly of FIG. 1.
Figure 3:
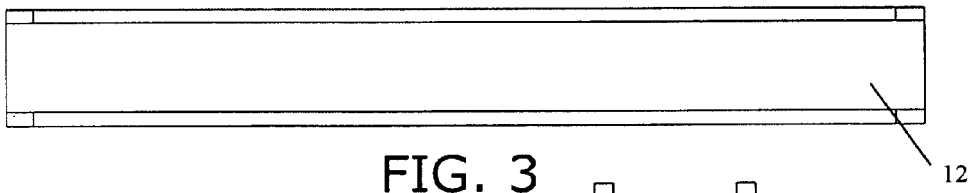
FIG. 3 is a top view of the inline connector assembly of FIG. 1.
Figure 4:
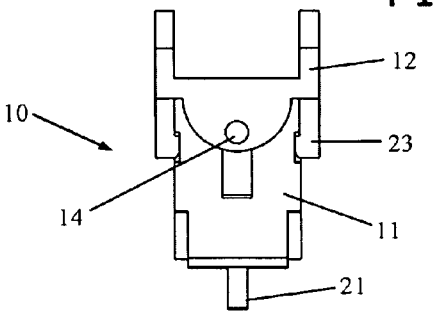
FIG. 4 is an end view of the inline connector assembly of FIG. 1.
Figure 5:
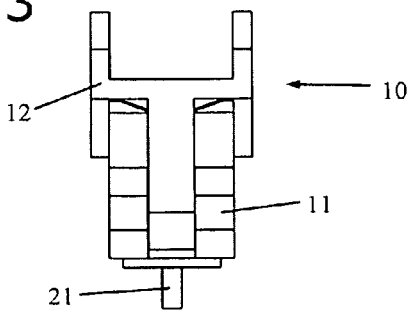
FIG. 5 is an end view showing the opposing end of the connector assembly of FIG. 4.
Figure 6:
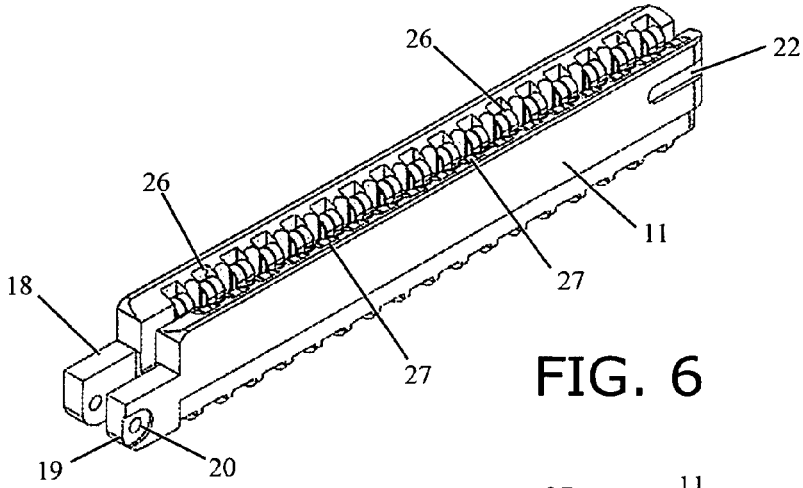
FIG. 6 is a perspective view of the bottom body structure of the assembly.

Referring to FIGS. 1-5, the connector assembly 10 is shown to comprise a formed bottom body member 11 hingedly attached by hinge pin 13 to a formed top body member 12. The top and bottom body members 11, 12 are formed of a nonconductive material. The bottom body member 11 may be formed of a card edge connector structure which is modified as further described below.

As further shown, the top body member 12 of the connector assembly 10 has a bore 14 at the end opposite hinge pin 13. The top member 12 is shown to have opposing latch members 23 which cooperate with latch grooves 22 at opposing lateral ends in bottom body member 11 as further described with respect to FIGS. 6-10 and FIGS. 11-14.

Referring to FIGS. 6-10, a perspective top view and top lateral and end plan views are shown of the formed bottom body member 11. The bottom body member 11 is shown to have opposing connecting members 18 and 19 at one end; each having an aperture 20 to receive the connecting member 15 of the top body member 12 and the cooperating hinge pin 13. At the opposite end of the bottom body member 11, a pair of opposing latch grooves 22 are shown and which cooperate with the opposing latch members 23 extending downwardly at the ends of the top body member 12 as shown in FIGS. 1-5.

Referring further to FIGS. 6-10, a plurality of opposing conductive resilient members 26 and 27 are shown mounted within bottom body member 11. As particularly shown in FIGS. 9 and 10, the opposing resilient members 26 and 27 are spaced from each other at a predetermined distance thereby forming a longitudinal channel through the bottom body member 11. The resilient and conductive members 26 and 27 are shown to be aligned leaf springs which provide opposing forces to hold an inline tail of an electrode therebetween. For example, the spacing between the opposing resilient members 26 and 27 may be approximately 1.0 mm. Subsequent the placement of an inline tail between the resilient members, the spacing between the resilient members may expand to approximately 1.5 mm to thereby hold therebetween an inline tail of approximately 1.5 mm in diameter. The resilient members 26 and 27 may be provided by means of a modified card edge connector structure having predetermined dimensions and resilient conductive member 26 and 27 spacings.

Figure 7:
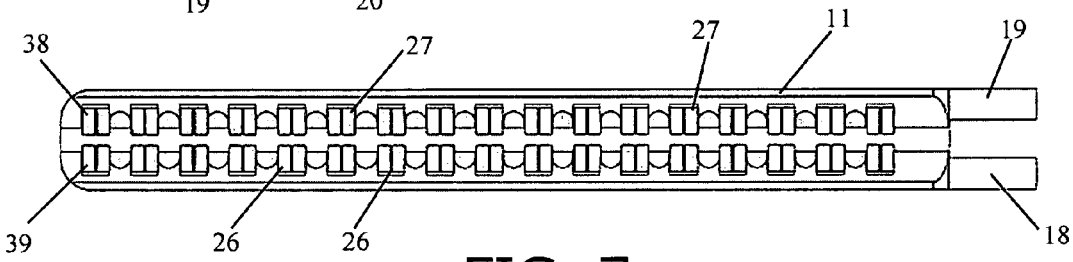
FIG. 7 is a top view of FIG. 10.
Figure 8:
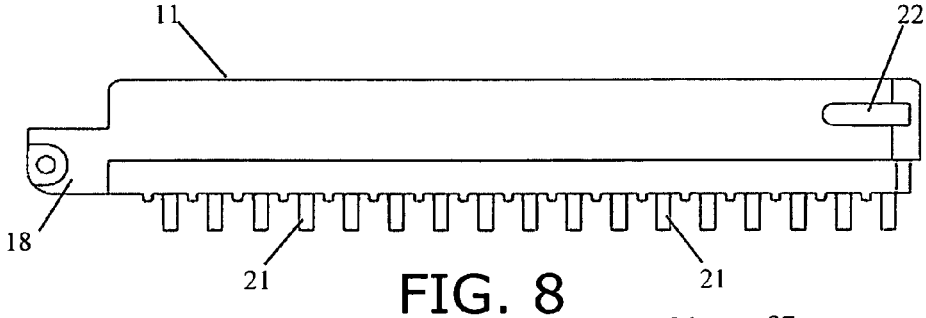
FIG. 8 is a lateral view of FIG. 10.
Figure 9:
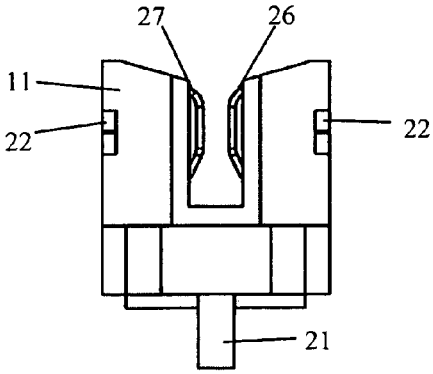
FIG. 9 is an end view of FIG. 10.
Figure 10:
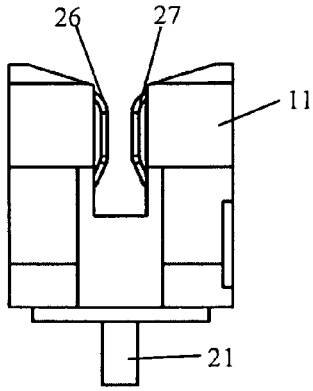
FIG. 10 is a plan end view of the opposite end of FIG. 13.
Figure 11:
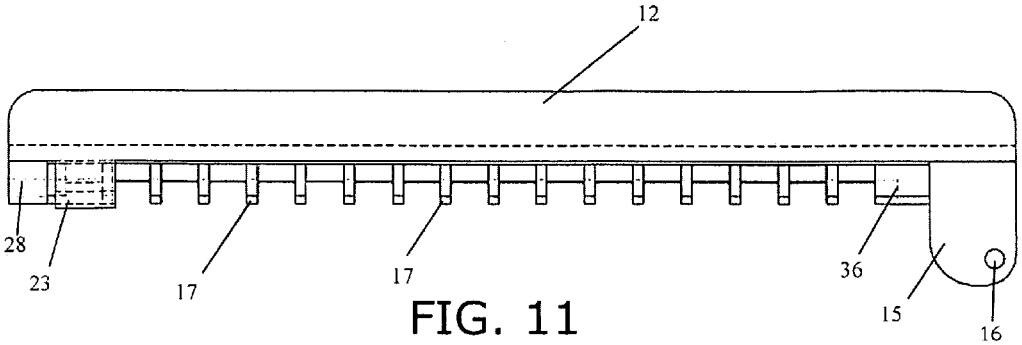
FIG. 11 is a lateral view of the top body structure of the assembly.
Figure 12:
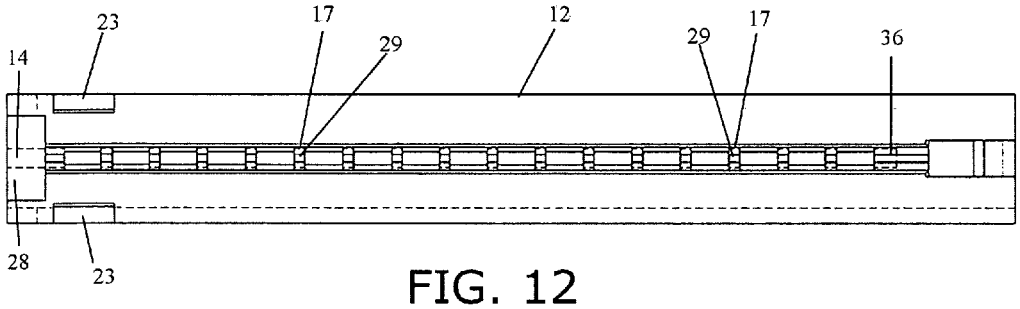
FIG. 12 is a bottom view of FIG. 6.
Figure 13:
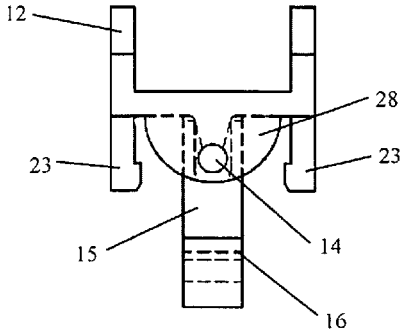
FIG. 13 is an end view of FIG. 6.
Figure 18:
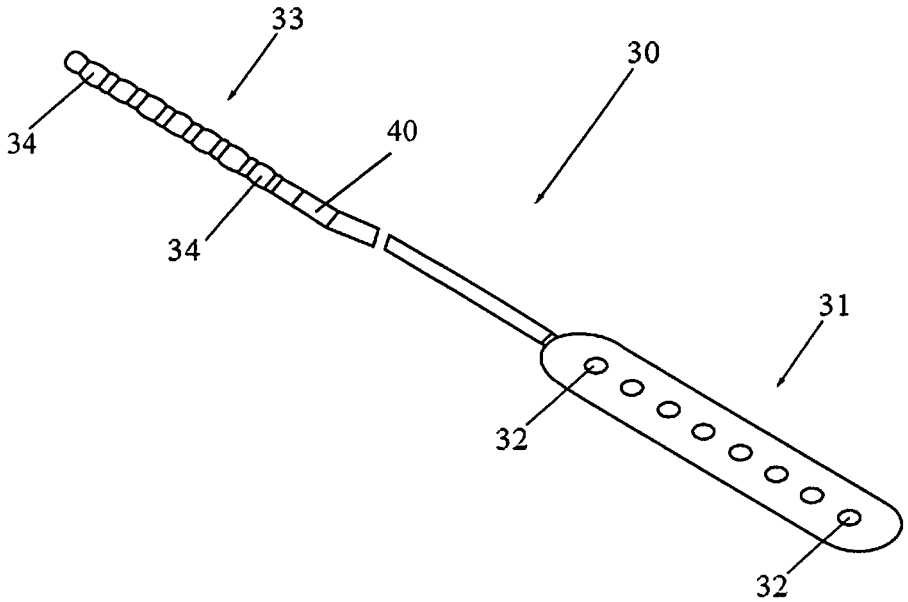
FIG. 18 is a perspective view of an electrode assembly having an electrode tail.

Resilient member pairs 26 and 27 may have bifurcated structures, as shown in the drawings, and which may also be utilized to grasp portion(s) of an inline tail structure between contacts and/or at its terminal portions, i.e., at the tail entry location, to further secure the inline tail structure within the inline connector assembly 10 when closed and in a latched position. For example, the first opposing pairs of resilient members 38 and 39, as shown in FIG. 7, may be positioned at the tail entry location to grasp or grip the inline tail 25 at an insulated or non-conductive portion 40 of the inline tail, as shown in FIG. 18.

Figure 14:
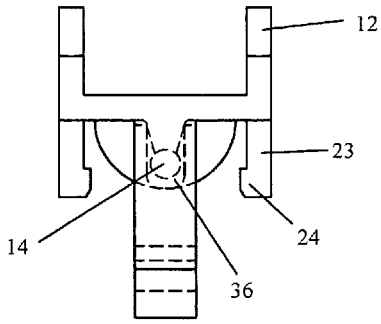
FIG. 14 is a view of the opposite end of FIG. 8.

Referring to FIGS. 11-14, lateral, bottom and end plan views are shown of the formed top body member 12. The top body member 12 is shown having an aperture or bore 16 in connecting member 15 for receiving hinge pin 13, as shown in FIG. 1 to thereby hingedly attach the top body member 12 to the bottom body member 11. As shown in FIG. 14, the latch members 23 of the top body member 12 each have an interior edge 24 for cooperatively engaging the latch grooves 22 in the bottom body member 11, as shown in FIG. 1. The top body member 12 is further shown to have a bore 14 at its frontal end to receive an electrode tail of an electrode assembly. For example, in FIG. 18 an electrode assembly 30 is shown having an electrode body 31 with a plurality of electrode contacts 32 which correspond with the contacts 34 of electrode tail 33. The electrode tail 33 is inserted into bore 14 of the connector assembly 10 shown in FIG. 19 which by means of electrical contact with resilient members 26, 27 permit signals to be transmitted through interconnection cable 35 to EEG recording equipment, for example. Set screw 37 is shown on the side of bottom body member 11 and which may be utilized to secure the interconnection cable 35 to the body member 11 and its electrical components. Other fastening means may be utilized and are within the purview of the invention.

Referring further to FIGS. 11-14, the top body member 12 is shown to have a plurality of aligned lead holder members 17, each having an aperture 29 which is in alignment with bore 14 positioned at one end of the top body member 12. A tail guide structure 28 is shown at the body end of bore 14. The lead holder members 17 hold the electrode tail and provide the downward force to push the tail between the aligned opposing resilient members 26, 27. The length of bore 14 within guide structure 28 is such so that the entrance of an electrode tail permits the tail (i.e. electrode tail 30 of FIG. 18) to be directed in alignment through the apertures 29 of the lead holder members 17. For example, the length of bore 14 may be approximately 0.19 inches in length and the spacing between the lead holder members 17 may be approximately 0.12 inches. As further shown, a bore stop 36 is shown in alignment with the apertures 29 of the lead holder members 17. The bore stop 36 is a cylindrical bore having a specified length and an end wall against which the terminal end of the inline tail abuts. The bore stop 36 provides for the proper alignment of the inline tail contacts with the corresponding pairs of resilient member 26 and 27.

Figure 15:
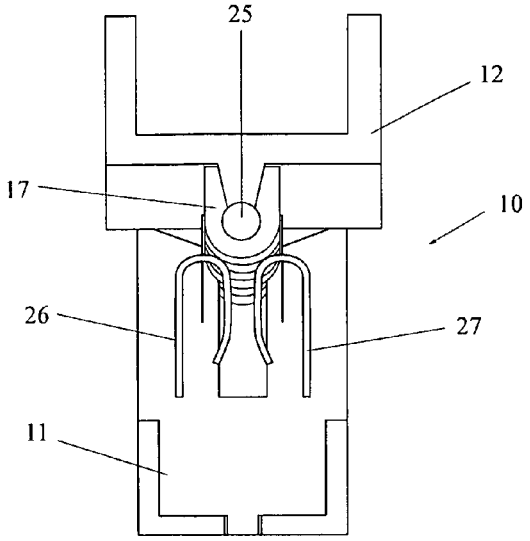
FIG. 15 is a sectional view showing the inline connector assembly in an opened position and having an inline tail positional in the top body member.
Figure 16:
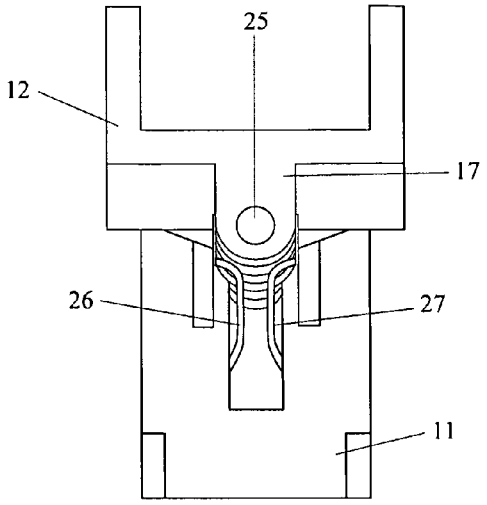
FIG. 16 is another sectional view showing the inline connector assembly in an open position.
Figure 17:
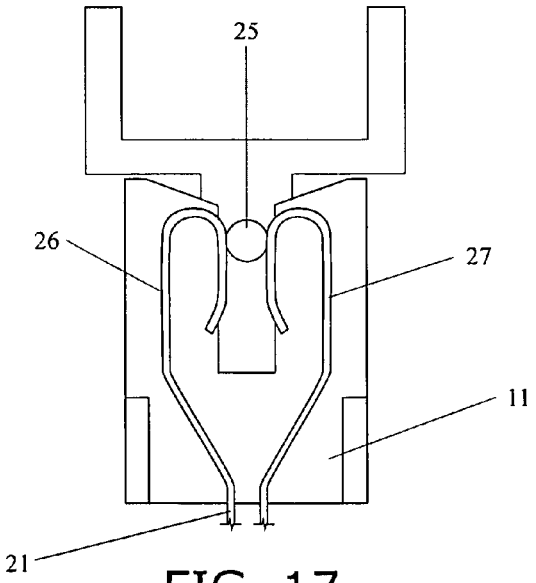
FIG. 17 is a sectional view showing the inline connector assembly in a closed position and having the contacts of the inline tail in contact with the resilient conductive members of the bottom body member.

Referring to FIGS. 15-17, the internal structure of the inline connector assembly 10 is shown. Specifically, the conductive resilient members 26 and 27 are shown in FIGS. 15 and 16 in a non-conductive state with respect to an inline tail 25 positioned within the top body member 12. The top body member 12 not being closed with respect to the bottom body member 11. The opposing conductive resilient members 26 and 27 are shown being spaced a predetermined distance from each other. In FIG. 17, the inline tail 25, having a diameter greater than the above referenced predetermined distance between the conductive resilient members, such as oppositely positioned leaf spring members 26, 27, is shown to be in contact with both resilient members 26 and 27, thereby providing electrical communication between the electrode and the apparatus, i.e., EEG or quick disconnect device, to which the inline connector assembly 10 is attached. The inline tail 25 is shown secured between the opposing corresponding pairs of resilient members 26 and 27 by means of leaf spring-like resilient member structures which provide opposing forces when spread apart. For example, the spacing between the opposing resilient members 26 and 27 may increase from 1.0 mm to 1.5 mm when gripping an inline tail 25 having a diameter of approximately 1.5 mm. The opposing conductive resilient members 26 and 27 are shown structurally being generally inverted u-shaped structures having outside portions which extend downwardly to the pin out portion 21 of the bottom body member 11.

The bottom body member 11 is shown having opposing and spaced resilient members 26 and 27 and the pinout structure 21 is shown. The bottom body member 11 may be a card edge connector structure which is modified for use to form the bottom body member 11 having spaced connecting members 18 and 19 and latch grooves 22 as discussed above.

Figure 19:
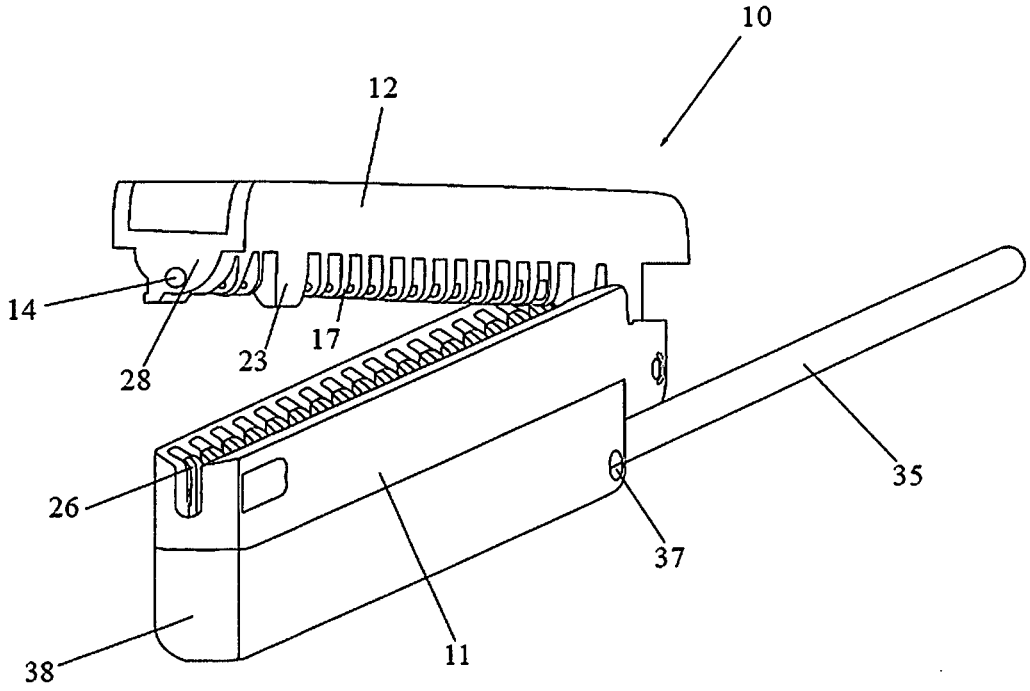
FIG. 19 is a perspective view of an inline connector assembly according to the teachings of the present invention.

Either top and/or bottom body members 12 and 11 may be provided with a clear viewing area or alternatively formed of an optically clear material to allow the end user to verify that the inline contacts, i.e. contacts 34 of electrode tail 35 shown in FIG. 19, are properly aligned with the resilient members 26 and 27 for each inline contact.

For example, top body member 12 may be formed of an optically clear polymeric composition, such as polycarbonate or the like, for viewing purposes. FIG. 19 further shows bottom cover portion 38 which covers the pin out 21 structures of the bottom body member 11 and from which the interconnection cable 35 extends. The interconnection cable 35 contains the conductor wires which are in electrical communication with the corresponding pin out 21 structures thereby providing identifiable signals for the inline tail contacts.

In summary, the formed bottom member 11 is shown to have an elongated body having terminal connecting portions 18 and 19, each having an aperture 20 which are aligned to receive a connecting member 15 of the top body member 12 and secured by hinge pin 13 to thereby form the connector assembly 10 of the invention. The connector assembly 10 further has locking means, electrode tail guide and stop means and which provides for the electrical connection of a tail of an electrode to EEG recording equipment, for example.

As many changes are possible to the inline connector assembly embodiments of this invention utilizing the teachings thereof, the descriptions above, and the accompanying drawing should be interpreted in the illustrative and not in the limited sense.

That which is claimed is:

1. An inline connector assembly comprising:

a) a bottom body structure having a longitudinal channel defined by a plurality of opposing, aligned and spaced resilient conductive members, each of said opposing and spaced resilient conductive members having a predetermined spacing therebetween to define said longitudinal channel;

b) a top body structure having a plurality of aligned depending members extending therefrom each having an aperture therethrough to define a longitudinal bore for the spatial alignment with said longitudinal channel defined by said spacing between said opposing resilient conductive members of said bottom body structure, said longitudinal bore being constructed and arranged to receive an inline tail with a plurality of spaced conductive portions; and c) hinged connection means joining said bottom body structure and said top body structure to thereby provide for the opening and closing of said inline connector assembly, whereby the positioning of the inline tail in said longitudinal bore of said top body structure results in the alignment of the spaced conductive portions of the inline tail with said opposing and spaced resilient members of said bottom body structure and wherein the inline tail is secured by the opposing forces exerted by said opposing resilient members on the inline tail when said connector assembly is in a closed configuration.

2. The inline connector assembly of claim 1 wherein said predetermined spacing between said opposing conductive members is less than the diameter of said longitudinal bore in said top body structure.

3. The inline connector assembly of claim 1 wherein said bottom and top body structures each have terminal ends and wherein said hinged connecting means are positioned at said terminal ends of said bottom and top body structures.

4. The inline connector assembly of claim 3 wherein said bore in said top body structure has inline tail guide means at the terminal end opposite said hinged connecting means.

5. The inline connector assembly of claim 1 wherein said assembly has means to lock said bottom and top body structures in an aligned configuration.

6. The inline connector assembly of claim 5 wherein said locking means is provided by cooperating latch grooves and latch members of said bottom and top body portions.

7. The inline connector assembly of claim 1 wherein said opposing resilient conductive members comprise leaf spring contacts.

8. The inline connecting assembly of claim 1 wherein said assembly includes terminally positioned and opposing spring members to grip the inline tail at a non-conductive portion of the inline tail.

9. The inline connecting assembly of claim 1 wherein said bottom body structure or said top body structure has a clear viewing area or wherein said bottom body structure or said top body structure is formed of an optically clear material.

10. An inline connector assembly comprising:

a) a bottom body structure having terminal ends and a longitudinal channel defined by a plurality of opposing and aligned resilient conductive members, each said opposing resilient conductive members having a predetermined spacing therebetween;

b) a top body structure having terminal ends and a plurality of depending members each having an aligned aperture to form a longitudinal bore for spatial alignment with said spacing between said opposing resilient conductive members of said bottom body structure, said longitudinal bore having an inline tail guide means and being constructed and arranged to receive an inline tail with a plurality of spaced conductive portions; and c) hinge means joining one terminal end of each said bottom and top body structures to provide for the opening and closing of said inline connector assembly, whereby the positioning of the inline tail in said longitudinal bore of said top body structure results in the alignment of the conductive portions of the inline tail with said opposing resilient members of said bottom body structure and wherein the inline tail is secured between said opposing resilient members when said connector assembly is in a closed configuration.

11. The inline connector assembly of claim 10 wherein said predetermined spacing between said opposing conductive members is less than the diameter of said longitudinal bore in said top body structure.

12. The inline connector assembly of claim 10 wherein said assembly has means to lock said bottom and top body structures in an aligned configuration, said locking means including a safety latch.

13. The inline connector assembly of claim 10 wherein said opposing resilient conductive members comprise leaf spring contacts.

14. The inline connecting assembly of claim 10 wherein said assembly includes terminally positioned spring members to grip the inline tail at a non-conductive portion of the inline tail.

15. The inline connecting assembly of claim 10 wherein said bottom body structure or said top body structure has a clear viewing area or wherein said bottom body structure or said top body structure is formed of an optically clear material.

16. An inline connector assembly comprising:

a) a bottom body structure having terminal ends and a longitudinal channel defined by a plurality of opposing, aligned and spaced resilient conductive members, each of said opposing resilient conductive members having a predetermined spacing therebetween, said opposing resilient conductive members comprising opposing leaf spring contacts, said bottom body structure including terminally positioned spring members to grip an inline tail at a non-conductive portion of the inline tail;

b) a top body structure having terminal ends and a plurality of downwardly extending members each having an aligned aperture thereby defining a longitudinal bore for spatial alignment with said spacing between said opposing resilient conductive members of said bottom body structure, said longitudinal bore being constructed and arranged to receive an inline tail with a plurality of spaced conductive portions; and c) hinge means at one terminal end of each said bottom and top body structures thereby joining said bottom body structure and said top body structure to provide for the opening and closing of said inline connector assembly, said longitudinal bore in said top body structure having inline tail guide means at the terminal end opposite said hinge means, whereby the positioning of the inline tail in said longitudinal bore of said top body structure results in the alignment of the spaced conductive portions of the inline tail with said spaced opposing resilient members of said bottom body structure and wherein the inline tail spreads and is secured between said opposing resilient members when said connector assembly is moved into a closed configuration.

17. The inline connector assembly of claim 16, wherein said assembly has means to lock said bottom and top body structures in an aligned configuration.

* * * * *